US009751544B2

(12) United States Patent
Yanai et al.

(10) Patent No.: US 9,751,544 B2
(45) Date of Patent: Sep. 5, 2017

(54) TRAIN TRAFFIC CONTROL INSPECTION DEVICE, TRAIN TRAFFIC CONTROL INSPECTION METHOD AND PROGRAM

(71) Applicant: MITSUBISHI HEAVY INDUSTRIES, LTD., Tokyo (JP)

(72) Inventors: Noritaka Yanai, Tokyo (JP); Toshihiko Niinomi, Tokyo (JP); Kenji Takao, Tokyo (JP); Yasuyuki Suzuki, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 237 days.

(21) Appl. No.: 14/655,106

(22) PCT Filed: Sep. 26, 2013

(86) PCT No.: PCT/JP2013/076102
§ 371 (c)(1),
(2) Date: Jun. 24, 2015

(87) PCT Pub. No.: WO2014/112159
PCT Pub. Date: Jul. 24, 2014

(65) Prior Publication Data

US 2015/0344050 A1 Dec. 3, 2015

(30) Foreign Application Priority Data

Jan. 21, 2013 (JP) ..... 2013-008563

(51) Int. Cl.
*B61L 27/00* (2006.01)
*B61L 19/00* (2006.01)
(Continued)

(52) U.S. Cl.
CPC ..... *B61L 27/0038* (2013.01); *B61L 19/06* (2013.01); *B61L 21/04* (2013.01); *B61L 27/0055* (2013.01)

(58) Field of Classification Search
CPC combination set(s) only.
See application file for complete search history.

(56) References Cited

U.S. PATENT DOCUMENTS 9,403,545 B2 * 8/2016 Pirtle ..... B61L 23/06
2015/0108284 A1 * 4/2015 Pirtle ..... B61L 23/06 246/4

FOREIGN PATENT DOCUMENTS

JP 2003-063398 A 3/2003
JP 3572479 B 10/2004
(Continued)

OTHER PUBLICATIONS

Japan Patent Office, "Office Action for JP 2013-008563," dated Nov. 17, 2015.

(Continued)

*Primary Examiner* — Yonel Beaulieu
(74) *Attorney, Agent, or Firm* — Manabu Kanesaka; Benjamin Hauptman; Kenneth Berner

(57) ABSTRACT

A train traffic control inspection device includes an information acquiring unit configured to acquire railroad topology information indicating a configuration of a railroad network in which a plurality of blocks are connected and which includes one or more branches, travel path information specifying a path of a train which travels in the railroad network on a combination of one or more routes for each train, route setting information in which conditions to be satisfied when a route request for reserving a path on which a train will travel is given are defined for each route, and
(Continued)

interlock system operation information in which safe operation logics of the interlock system are defined.

7 Claims, 18 Drawing Sheets

(51) Int. Cl.
*B61L 21/04* (2006.01)
*B61L 19/06* (2006.01)

(56) References Cited

FOREIGN PATENT DOCUMENTS

| | | | | | |
|---|---|---|---|---|---|
| JP | 2010-215158 | A | | 9/2010 | |
| JP | 2011-131812 | A | | 7/2011 | |
| JP | GB 2497228 | A | * | 6/2013 | ..... B61L 27/0027 |
| WO | 2012/176348 | A1 | | 12/2012 | |

OTHER PUBLICATIONS

PCT/ISA/210, "International Search Report for International Application No. PCT/JP2013/076102," dated Dec. 17, 2013.
PCT/ISA/237, "Written Opinion of the International Searching Authority for International Application No. PCT/JP2013/076102," dated Dec. 17, 2013.

* cited by examiner

*FIG. 4A*

<ROUTE INFORMATION 1 – COURSE ELEMENT>

| COURSE ELEMENT | BLOCK | DIRECTION | SUBSEQUENT COURSE ELEMENT | REVERSE COURSE ELEMENT |
|---|---|---|---|---|
| S1 | T1 | → | S2 | S11 |
| S2 | T2 | → | S4 | S12 |
| S3 | T2 | → | S4 | S13 |
| ⋮ | ⋮ | ⋮ | ⋮ | ⋮ |

*FIG. 4B*

<ROUTE INFORMATION 2 – COURSE SECTION>

| COURSE SECTION | COURSE ELEMENT |
|---|---|
| 1R | S1 |
| 3R | S2,S4 |
| 4AR | S8,S9 |
| 4BR | S7,S3,S4 |
| ⋮ | ⋮ |

*FIG. 5B*

<TRAVEL PATH INFORMATION>

| TRAIN | INITIAL COURSE ELEMENT | COURSE |
|---|---|---|
| A | S6 | ABR,7R |
| B | S20 | 6L,4L |
| ⋮ | ⋮ | ⋮ |

*FIG. 6*

<COURSE SETTING INFORMATION>

| COURSE SECTION | COURSE REQUEST CONDITION | REQUEST CANCELLATION CONDITION |
|---|---|---|
| 3R | T1 & T3 | T1 & T3 |
| 7R | T5 & T7 | T5 & T7 |
| 6L | T8 & T6 | T8 & T6 |
| 4L | 4AR & 4BR & T6 & T4 | T6 & T4 |
| ⋮ | ⋮ | ⋮ |

*FIG. 7*

<INTERLOCKING SYSTEM OPERATION INFORMATION>

| COURSE SECTION | LOGICAL EXPRESSION |
|---|---|
| 3R | !3AL * !3BL * !5L * !4BR * 3RX |
| 3AL | !1R * !3R * !3BL * !4BR * 7R * 3ALX |
| 3BL | !2R * !3R * !3AL * !4AR * !4BR * !4L * 7R * 3BLX |
| ⋮ | ⋮ |

STATE TRANSITION MODEL OF COURSE LEVER RELAY
(COURSE SECTION 3R)

STATE TRANSITION MODEL OF TRAIN PRESENCE DETECTION RELAY
(BLOCK T1)

STATE TRANSITION MODEL OF BRANCH DETECTION
(FORWARD-OPENED STATE) RELAY

STATE TRANSITION MODEL OF BRANCH DETECTION
(REVERSELY-OPENED STATE) RELAY

*FIG. 16A*

<EXAMPLE IN WHICH STATE TRANSITION MODEL IS GENERATED USING MODEL INSPECTION LANGUAGE OF INTERLOCKING SYSTEM (COURSE LEVER RELAY)>

```
next(_113R_113R) := next(_113R_113R_X) & !_114L_114R & !_112L_112R &
!_113L_113R & !_113L_113N & !_112L_112N;
next(_114L_114R) := next(_114L_114R_X) & !next(_113R_113R) & !_CSCSR &
!_114R_114R & !_114R_114N;
next(_111R_111R) := next(_111R_111R_X) & !_112L_112R & !_111L_111R &
!_111L_111N & !_8L2L;
next(_112L_112R) := next(_112L_112R_X) & !next(_113R_113R) &
!next(_111R_111R) & !_113R_113N & !_112R_112R & !_112R_112N;
```

*FIG. 16B*

<EXAMPLE IN WHICH STATE TRANSITION MODEL IS GENERATED USING MODEL INSPECTION LANGUAGE OF INTERLOCKING SYSTEM (TRAIN PRESENCE DETECTION RELAY)>

```
next(_8L2T) :=
        case
                train1.pos = _8L2#R |
                train1.pos = _8L2#L |
                train1.pos = _111#R-8L2 |
                train1.pos = _111#N-8L2 |
                train1.pos = _8L2-111#R |
                train1.pos = _8L2-111#N |
                train2.pos = _8L2#R |
                train2.pos = _8L2#L |
                train2.pos = _111#R-8L2 |
                train2.pos = _111#N-8L2 |
                train2.pos = _8L2-111#R |
                train2.pos = _8L2-111#N
                        : FALSE;
                TRUE : TRUE;
        esac;
```

*FIG. 16C*

<EXAMPLE IN WHICH STATE TRANSITION MODEL IS GENERATED USING MODEL INSPECTION LANGUAGE OF INTERLOCKING SYSTEM (BRANCH DETECTION RELAY)>

```
next(_113_NK) :=
        case
                _113_NW & !_113_RW & !_113_NK : { TRUE, FALSE };
                !_113_NW & _113_RW &  _113_NK : { TRUE, FALSE };
                TRUE : _113_NK;
        esac;
```

TRAIN TRAFFIC CONTROL INSPECTION DEVICE, TRAIN TRAFFIC CONTROL INSPECTION METHOD AND PROGRAM

RELATED APPLICATIONS

The present application is National Phase of International Application No. PCT/JP2013/076102 filed Sep. 26, 2013, and claims priority from Japanese Application No. 2013-008563, filed Jan. 21, 2013, the disclosure of which is hereby incorporated by reference herein in its entirety.

TECHNICAL FIELD

The present invention relates to a train traffic control inspection device, a train traffic control inspection method, and a program which serve to inspect a traffic schedule of a train traveling a previously-provided railroad.

Priority is claimed on Japanese Patent Application No. 2013-8563, filed Jan. 21, 2013, the content of which is incorporated herein by reference.

BACKGROUND ART

Existing systems for controlling traffic of railroad vehicles are classified into "safety related systems" for securing safety in operation thereof and "non-safety related systems" for achieving various purposes independently thereof.

"Security systems" are systems for controlling traffic of trains such that the trains neither collide nor derail. Representative examples thereof include an automatic train control (ATC) system and an "interlock system". Here, an "interlock system" means a system that controls traffic signals and switch stands (devices that switch a route of a train in a branch) to interlock with each other.

On the other hand, "non-safety related systems" mean systems not corresponding to the "safety related systems" among systems mainly required for operating railroads as a transportation system. A representative example thereof is a "traffic control system" that causes a train to travel or stop in accordance with a train diagram. Ticket examination facilities and the like are also examples thereof.

In a train traffic control system that controls traffic of trains while causing the traffic control system which is a non-safety related system and the interlock system which is a safety related system to function independently, it is necessary to form a traffic logic which do not cause "deadlock" in a traffic processes thereof. Here, the "deadlock" means a state in communication between the traffic control system and the interlock system in which the traffic processes of trains can no longer progress.

Therefore, a designer of traffic logic needs to verify in advance whether the "deadlock" can occur in the traffic processes that are sequentially performed in accordance with the traffic logic.

Regarding the "interlock system" as the "safety related system", a method of automating verification of such an operation and saving energy is disclosed (Patent Literature 1).

CITATION LIST

Patent Literature

[Patent Literature 1]

Japanese Unexamined Patent Application, First Publication No. 2011-131812

SUMMARY OF INVENTION

Technical Problem

However, a train does not travel merely in accordance with a train diagram and a certain degree of delay may occur. Combinations of positions and routes of the train in which the delay may occur are enormous and it is difficult for even an expert to design traffic logic that avoids the deadlock in all combinations.

The "interlock system" and the "traffic control system" control trains independently (asynchronously) based on a variety of information such as railroad topology information, positions of trains, route of trains, and train diagrams. In the method described in Patent Literature 1, although the operation of the "interlock system" can be verified, the operation of the entire train traffic control system in which the "interlock system" and the "traffic control system" are combined cannot be verified.

The "interlock system" and the "traffic control system" asynchronously control traffic of a train independently as described above. Accordingly, a very large number of combinations of instruction patterns which are transmitted therefrom can be considered for the traffic processes which progress from moment to moment. Existing inspection systems cannot verify whether there is a possibility of "deadlock" occurring in all of the very large number of instruction patterns. For example, there is actually a slight time lag between a timing at which a train enters a block and a timing at which the interlock system actually recognizes the entrance of the train. Hitherto, it has not been possible to verify problems such as what happens when a route request of another train is given from the traffic control system during the time lag.

An object of the present invention is to provide a train traffic control inspection device, a train traffic control inspection method, and a program which can solve the above-identified problems.

Solution to Problem

According to a first aspect of the present invention, there is provided a train traffic control inspection device that verifies an operation of a train traffic control system including an interlock system and a traffic control system, including: an information acquiring unit configured to acquire railroad topology information indicating a configuration of a railroad network in which a plurality of blocks are connected and which includes one or more branches, travel path information specifying a path of a train which travels in the railroad network by combination of one or more routes for each train, route setting information in which conditions to be satisfied when a route request for reserving a path on which a train will travel is given are defined for each route, and interlock system operation information in which safe operation logics of the interlock system are defined; a state transition model generating unit configured to generate a state transition model for each of the train, the branch, the interlock system, and the traffic control system based on the information acquired by the information acquiring unit; and a state transition model inspecting unit configured to determine whether a predetermined requirement is satisfied by combinations of states assumed in the train, the branch, the interlock system, and the traffic control system depending on the state transition models.

A second aspect of the present invention provides the train traffic control inspection device according to the first aspect, wherein the state transition model generating unit generates a state transition model including at least a state in which the train is in each route element obtained by dividing the route in units of the blocks and a state in which the train crosses a boundary of each route element as the states assumed in the train.

A third aspect of the present invention provides the train traffic control inspection device according to the first or second aspect, wherein the state transition model generating unit generates a state transition model including at least a forward-opened state, an in-transition state, and a reversely opened state as the states assumed in the branch.

A fourth aspect of the present invention provides the train traffic control inspection device according to any one of the first to third aspects, wherein the state transition model generating unit generates a state transition model including at least a state indicating whether each route is locked and a state indicating whether a train is present in each block as the states assumed in the interlock system.

A fifth aspect of the present invention provides the train traffic control inspection device according to any one of the first to fourth aspects, wherein the state transition model generating unit generates a state transition model including at least a progress state of a route request step for each train and a state indicating whether a route request for each route is present as the states assumed in the traffic control system.

According to a sixth aspect of the present invention, there is provided a train traffic control inspection method of verifying an operation of a train traffic control system including an interlock system and a traffic control system, including: acquiring railroad topology information indicating a configuration of a railroad network in which a plurality of blocks are connected and which includes one or more branches, travel path information specifying a path of a train which travels on the railroad network by combination of one or more routes for each train, route setting information in which conditions to be satisfied when a route request for reserving a path on which a train will travel is given are defined for each route, and interlock system operation information in which safe operation logics of the interlock system are defined; generating a state transition model for each of the train, the branch, the interlock system, and the traffic control system based on the acquired information; and determining whether a predetermined requirement is satisfied by combinations of states assumed in the train, the branch, the interlock system, and the traffic control system depending on the state transition models.

According to a seventh aspect of the present invention, there is provided a program which causes a computer of a train traffic control inspection device, which verifies an operation of a train traffic control system including an interlock system and a traffic control system, to serve as: information acquiring means configured to acquire railroad topology information indicating a configuration of a railroad network in which a plurality of blocks are connected and which includes one or more branches, travel path information specifying a path of a train which travels on the railroad network by combination of one or more routes for each train, route setting information in which conditions to be satisfied when a route request for reserving a path on which a train will travel is given are defined for each route, and interlock system operation information in which safe operation logics of the interlock system are defined; state transition model generating means configured to generate a state transition model for each of the train, the branch, the interlock system, and the traffic control system based on the information acquired by the information acquiring unit; and state transition model inspecting means configured to determine whether a predetermined requirement is satisfied by combinations of states assumed in the train, the branch, the interlock system, and the traffic control system depending on the state transition models.

Advantageous Effects of Invention

According to the train traffic control inspection device, the train traffic control inspection method, and the program, it is possible to inspect the train traffic control system to include situations with a low probability of occurring in operation of the train traffic control system.

BRIEF DESCRIPTION OF DRAWINGS

FIG. 4A is a third diagram showing railroad topology information according to an embodiment of the present invention.

FIG. 4B is a fourth diagram showing railroad topology information according to an embodiment of the present invention.

FIG. 5B is a second diagram showing travel path information according to an embodiment of the present invention.

FIG. 6 is a diagram showing route setting information according to an embodiment of the present invention.

FIG. 7 is a diagram showing interlock system operation information according to an embodiment of the present invention.

FIG. 16A is a first diagram showing a state transition model in a predetermined model inspection language according to an embodiment of the present invention.

FIG. 16B is a second diagram showing a state transition model in a predetermined model inspection language according to an embodiment of the present invention.

FIG. 16C is a third diagram showing a state transition model in a predetermined model inspection language according to an embodiment of the present invention.

DESCRIPTION OF EMBODIMENTS

Hereinafter, a train traffic control inspection device according to an embodiment of the present invention will be described with reference to the accompanying drawings.

Figure 1:
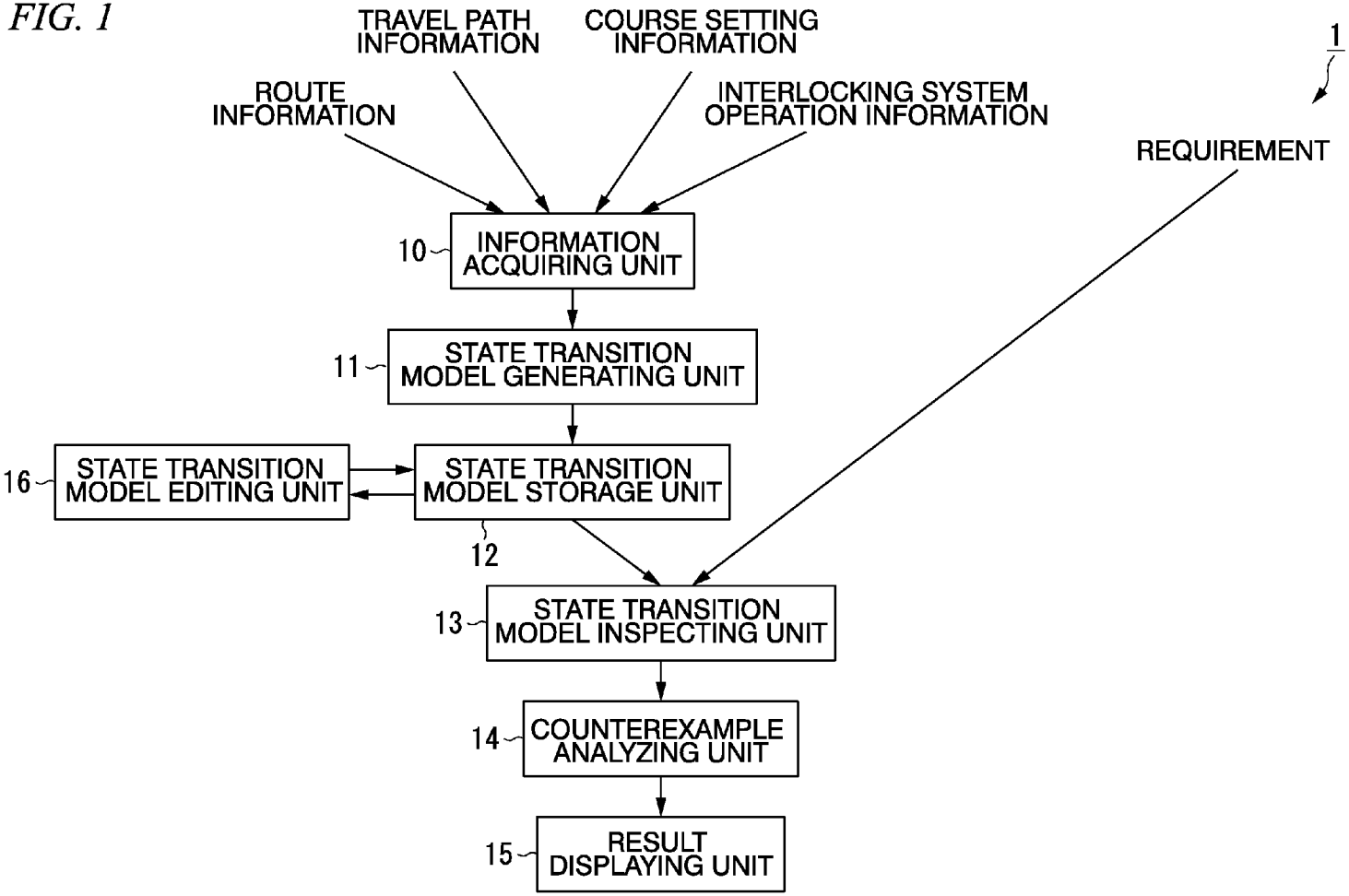
FIG. 1 is a diagram showing a functional configuration of a train traffic control inspection device according to an embodiment of the present invention.

FIG. 1 is a diagram showing a functional configuration of a train traffic control inspection device according to an embodiment of the present invention. In the drawing, reference numeral 1 denotes the train traffic control inspection device.

The train traffic control inspection device 1 is an inspection device for verifying an operation of a train traffic control system including an "interlock system" and a "traffic control system." In order to realize the inspection function, the train traffic control inspection device 1 includes an information acquiring unit 10, a state transition model generating unit 11, a state transition model storage unit 12, a state transition model inspecting unit 13, a counterexample analyzing unit 14, a result displaying unit 15, and a state transition model editing unit 16.

The information acquiring unit 10 is a functional unit that acquires information required for inspection of train traffic control. The information acquired by the information acquiring unit 10 includes railroad topology information, travel path information, route setting information, and interlock system operation information. Here, the "railroad topology information" is information indicating a configuration of a railroad network in which a plurality of blocks are connected and which includes one or more branches. The "travel path information" is information for specifying a "path" of a train traveling in the railroad network on a combination of one or more "routes" for each train. The "route setting information" is information for setting conditions in which a route request for causing the interlock system to reserve a path on which a train will travel is given for each route. The "interlock system operation information" is information for defining safe operation logic of the interlock system. The train traffic control inspection device 1 may include a particular storage unit for storing the variety of information. Specific meanings and details of the variety of information will be described later.

The state transition model generating unit 11 generates a state transition model for each of a train, a branch, the interlock system, and the traffic control system based on the variety of information acquired by the information acquiring unit 10. The train traffic control inspection device 1 according to this embodiment can inspect the entire train traffic control system in which the "interlock system" and the "traffic control system" work in cooperation depending on various state transition models generated by the state transition model generating unit 11.

The state transition model storage unit 12 temporarily stores the state transition models for repeated verification of the state transition models generated by the state transition model generating unit 11. The train traffic control inspection device 1 according to this embodiment may not include the state transition model storage unit 12 and the state transition model generating unit 11 may directly output a state transition model to the state transition model inspecting unit 13.

The state transition model inspecting unit 13 determines whether predetermined conditions are satisfied by combinations of states which are assumed in the train, the branch, the interlock system, and the traffic control system depending on the state transition models generated by the state transition model generating unit 11. A user of the train traffic control inspection device 1 can determine whether details of the variety of originally-provided information such as the "railroad topology information," the "travel path information," the "route setting information," and the "interlock system operation information" satisfy requirements based on the inspection result by the state transition model inspecting unit 13.

When a counterexample not satisfying the requirements occurs in the inspection result by the state transition model inspecting unit 13, the counterexample analyzing unit 14 facilitates detailed tracking of reasons for the occurrence of the counterexample. The counterexample analyzing unit 14 corresponds to a so-called debugging tool. The train traffic control inspection device 1 according to this embodiment may not include the counterexample analyzing unit 14 and the result displaying unit 15 may merely display the inspection result through the state transition model inspecting unit 13.

The result displaying unit 15 outputs the counterexample analysis result from the counterexample analyzing unit 14 or the inspection result from the state transition model inspecting unit 13 in a form which can be visually recognized by a user. In this embodiment, the result displaying unit 15 is, for example, a general-purpose display monitor.

The state transition model editing unit 16 constructs a desired state transition model by allowing a user to directly edit the state transition models temporarily stored in the state transition model storage unit 12. The state transition model editing unit 16 allows the user to freely edit the state transition model when the state transition model constructed by the state transition model generating unit 11 is not intended by the user, or the like. In this embodiment, this editing function is not necessary.

Now, before the train traffic control inspection device 1 is described, the "interlock system" and the "traffic control system" which are assumed to be included therein will be described.

The "interlock system" is a representative example of a "safety related system" and is a device that controls traffic lights and switch stands (devices that switch a route of a train in a branch) to interlock with each other. For example, if a train passes through a place while a switch stand is moving, the train will derail. Accordingly, the interlock system performs interlock control for displaying "red" with a predetermined traffic light such that the train does not enter the place of the switch stand while the switch stand is moving. When a train is present in a certain "block" (to be described later) the interlock system controls a traffic light such that no other train enters the block. The interlock system prevents collision or derailment of trains and secures safety as a transportation system by performing this control.

The interlock system receives a route request from the traffic control system (the "traffic control system" and the "route request" will be described later). The interlock system secures the route in response to the received route request. This is called route reservation. For example, when the interlock system receives a route request for a "route" (to be described later) on which train A will travel from the traffic control system, the interlock system establishes the route reservation of train A for the route by controlling the traffic lights and the switch stands such that train A can safely travel in the route (and no other train enters the route) in response to the route request. When a route request for another train includes a section competing with the route reserved for train A, the interlock system does not receive the route request. The interlock system determines whether the route reservation is established in accordance with a predetermined "safe operation logic" (to be described later).

A "block" means a section when a given railroad network is partitioned into regular sections. The interlock system allocates a unique identifier to each block to identify and manage the blocks. The interlock system prevents collision of trains by preventing two or more trains from entering one block. In general, the interlock system uses a track circuit as means for determining whether a train is present in a block. The track circuit is a device that electrically detects whether two rails constituting a railroad are short-circuited due to presence of a train. Accordingly, the interlock system can determine whether a train is present in the block.

The "traffic control system" is a system that performs control for causing a train to travel in accordance with a predetermined train diagram. The traffic control system has a function (referred to as a "route request" function) of identifying a path on which a train will travel based on a scheduled train diagram (1) and an actual train state and position (2) for each train and requesting reservation of a route for each train for the interlock system. Here, an "automatic route setting" function to be described later is a representative function of the traffic control system. The traffic control system is a system that gives an instruction to a train such that the train merely travels in accordance with the train diagram and does not consider safety such as whether the train will collide. Safe traveling in which a train avoids collision and derailment is secured by allowing the interlock system as the "safety related system" to monitor a train traffic situation independently of the traffic control system.

Figure 2:
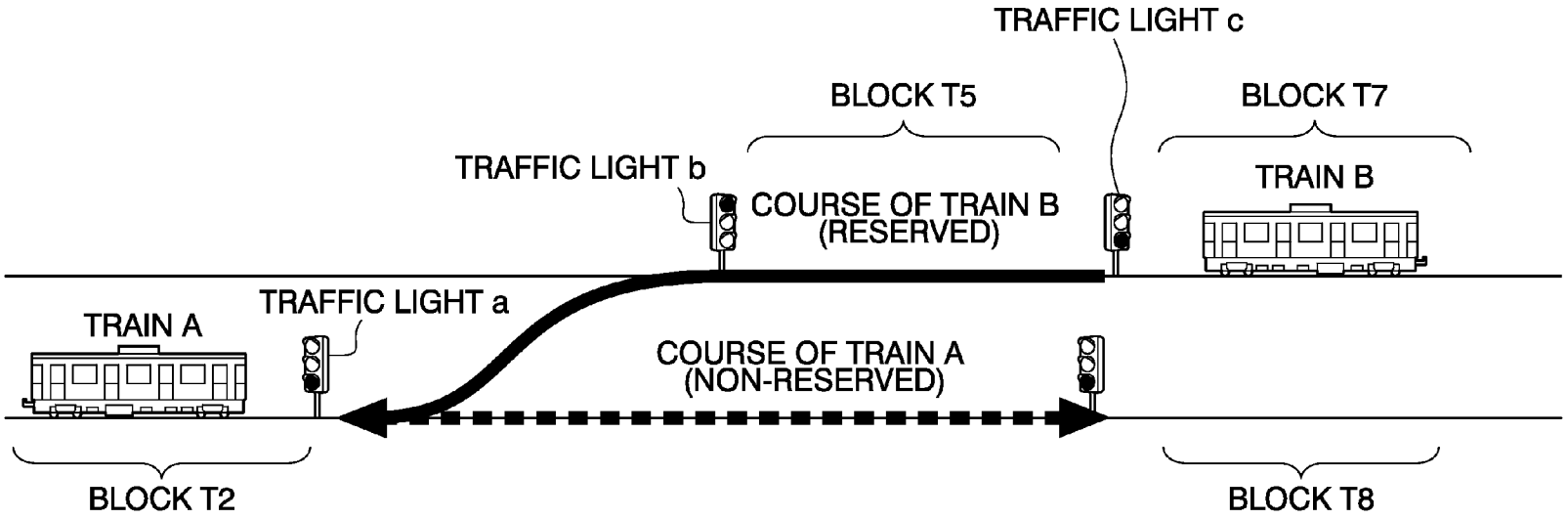
FIG. 2 is a diagram showing positions of trains in a railroad network and a path of each train.

FIG. 2 is a diagram showing positions of trains in a railroad network and a path of each train. Now, the "automatic route setting," the "path," the "route," and the "deadlock" will be described in detail with reference to FIG. 2.

The "automatic route setting" is one function of the traffic control system. In a train diagram, it is assumed that train A starts from block T2 (FIG. 2) at time X and arrives as block T8 at time Y. Then, the traffic control system automatically extracts a "path" for train A for realizing this assumption from a predetermined railroad network using the "automatic route setting" function, divides the path into predetermined "routes," and gives a route request to the interlock system.

Here, the "path" is the overall road connecting a current position of a train to a destination thereof and is specified by a combination of one or more "routes." The "route" means a predetermined traveling section of a train including one or more adjacent blocks. A traffic light of the interlock system is generally installed in an entrance of a route and the interlock system sequentially gives instructions indicating whether a train may travel on the respective routes using the traffic lights.

The "deadlock" means a state in which the exchange of a route request and a route reservation between the interlock system and the traffic control system no longer progresses in a traffic process of a train. A situation in which the deadlock occurs will be specifically described below with reference to FIG. 2.

FIG. 2 shows a situation in which train A and train B travel along paths shown in the drawing. Here, it is assumed that train B starts from block T7 at time Y (FIG. 2) and arrives at block T2 at time Y in addition to the assumption of train A. It is also assumed that the route reservation of train B is established earlier in a step in which the path of train A has not yet been reserved in the interlock system. Then, since the route on which train A earlier travels from block T2 is already reserved for train B, train A cannot move from block T2 (traffic light a maintains a "red" display and the interlock system does not receive the route request for train A). On the other hand, the interlock system causes traffic light b and traffic light c to display "green" lighting for train B. Train B travels to the front of traffic light a according to the "green" lighting of traffic light b and traffic light c. However, since train A is located ahead in block T2, the interlock system causes train B not to move any more so as to avoid collision (traffic light a displays "red" lighting for train B). Then, train A and train B do not move ahead due to their presence and the route reservations. In this way, the situation in which the traffic process does not progress and train A and train B do not arrive at their destinations is referred to as "deadlock". Since the deadlock is caused by the normal operation of the interlock system, the deadlock does not cause any problem in terms of safety (train A and train B do not collide with each other). However, the deadlock is a case in which the traffic process of trains does not progress as scheduled in the traffic control system, and problems in a traffic schedule occur. Accordingly, in actual operation of the traffic control system, the route request is given based on the "route setting information" (to be described later) in which conditions for the route request to satisfy in order to avoid causing the deadlock are described.

Hereinafter, specific details of the "railroad topology information," the "travel path information," the "route setting information," and the "interlock system operation information" which are acquired by the information acquiring unit 10 of the train traffic control inspection device 1 will be described with reference to the drawings.

Figure 3A:
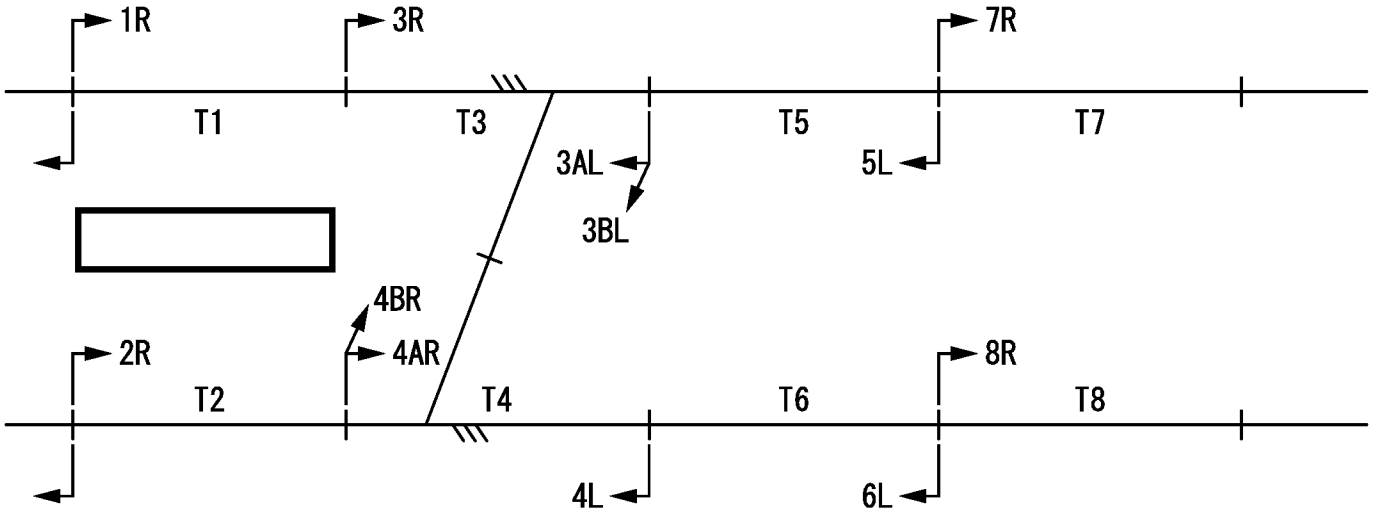
FIG. 3A is a first diagram showing railroad topology information according to an embodiment of the present invention.
Figure 3B:
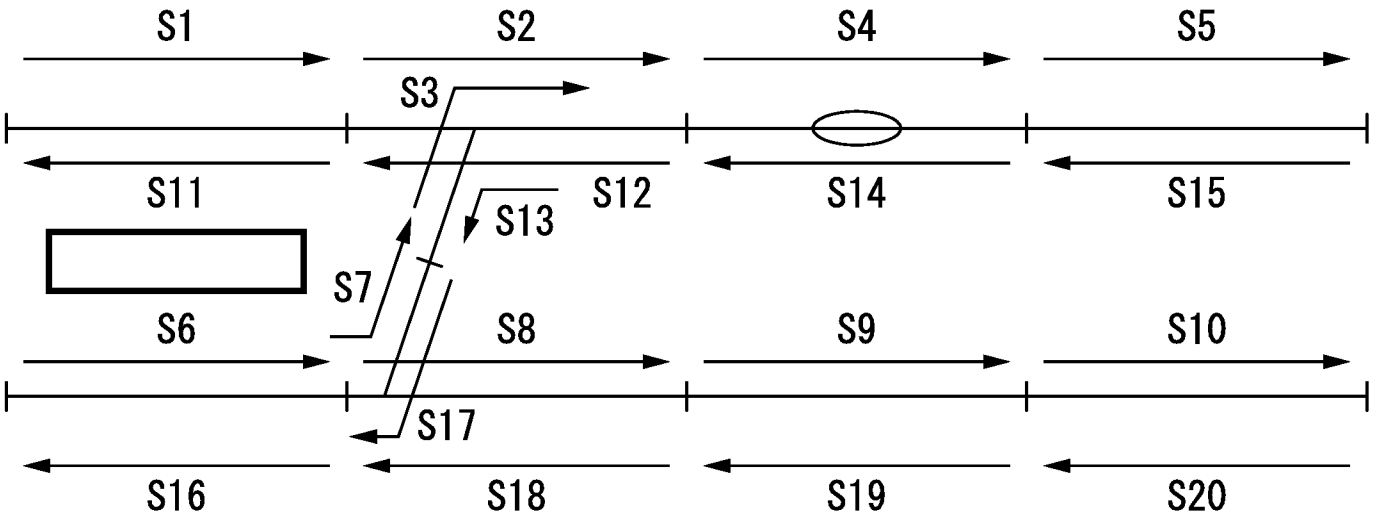
FIG. 3B is a second diagram showing railroad topology information according to an embodiment of the present invention.

FIGS. 3A and 3B are first and second diagrams showing the railroad topology information according to an embodiment of the present invention.

The "railroad topology information" used in this embodiment is information indicating a configuration of a railroad network in which a plurality of blocks are connected and which includes one or more branches. Here, the railroad topology information according to this embodiment is constructed by extracting "route elements" (to be described later) in units of blocks constituting the railroad, defining mutual connection relationships between the route elements and a correspondence relationship with the route, and specifying the overall railroad network. The railroad topology information to be described below is an example and this embodiment is not limited to this example.

Here, a "route element" means a section corresponding to one block from a boundary of a block to a boundary of a block in this embodiment. That is, route elements are the smallest units for defining a route by combination thereof. All routes are defined by combinations of route elements obtained by dividing the routes into units of blocks.

Here, it is assumed that a given railroad network is a railroad shown in FIG. 3A. The railroad shown in FIG. 3A includes a total of eight blocks, that is, blocks T1 to T8. The railroad includes a line connecting block T3 and block T4 to each other. Reference signs such as "1R," "4BR," and "4L" in FIG. 3A denote routes in the railroad. For example, route 1R is a route corresponding to one block and going through block T1 from left to right in the drawing. Course 4L is a route corresponding to two blocks and going through block T4 and block T2 from right to left on the drawing. Reference signs such as "1R" and "3R" may be considered to be traffic lights installed in entrances of the routes.

The railroad topology information according to this embodiment specifies the overall railroad network using the route elements obtained by dividing each route into units of blocks as the smallest units, as shown in FIG. 3B. As shown in FIG. 3B, the given railroad network can be expressed to include a total of 20 route elements, that is, route elements S1 to S20. Specifically, the mutual connection relationships between the route elements and the correspondence relationship with the routes are defined for each route element and for each route.

FIGS. 4A and 4B are third and fourth diagrams showing railroad topology information according to an embodiment of the present invention.

Specifically, the railroad topology information is information constructed in tables shown in FIGS. 4A and 4B. The table shown in FIG. 4A is a correspondence table indicating the connection relationships between the route elements. For example, route element S1 belongs to block T1 and the direction thereof is right (→), a subsequent route element thereof is S2, and a reverse route element corresponding to route element S1 is S11. The table shown in FIG. 4B indicates the types of route elements constituting each route. For example, route 1R includes only route element S1. Course 4BR includes three route elements, that is, route elements S7, S3, and S4 (see FIGS. 3A and 3B). The information acquiring unit 10 according to this embodiment receives a correspondence table shown in FIGS. 4A and 4B as the railroad topology information.

Figure 5A:
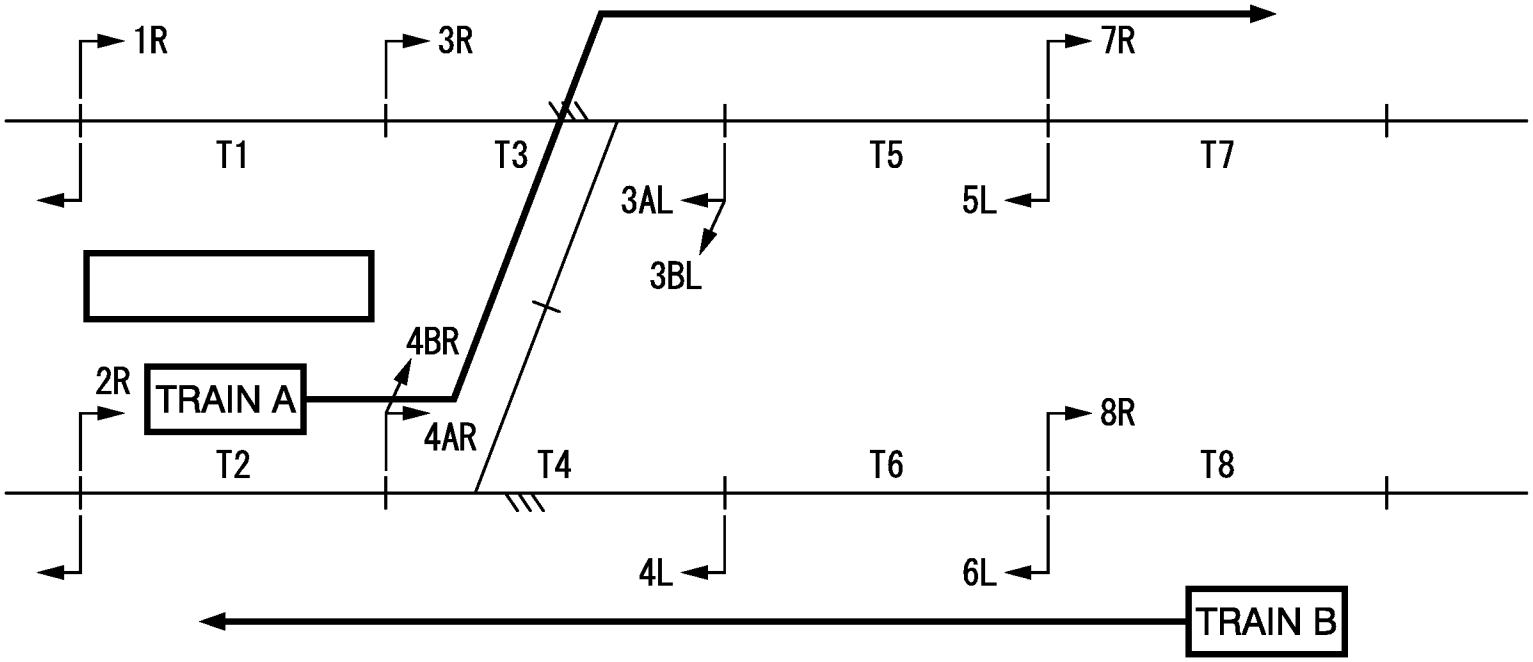
FIG. 5A is a first diagram showing travel path information according to an embodiment of the present invention.

FIGS. 5A and 5B are first and second diagrams showing the travel path information according to an embodiment of the present invention.

The "travel path information" used in this embodiment will be described below. The "travel path information" is information for defining a traffic pattern of a train which is assumed to be inspected. For example, the "travel path information" specifies a path of a train, which travels in the railroad network, on a combination of one or more routes for each train. More specifically, a path of each train is specified by giving an initial position (initial route element) and permutations of routes through which a train passes for each train. For example, it is assumed that train A and train B travel on the paths indicated in Table 5A. Then, the initial position (initial route element) of train A is S6 (see FIGS. 3A and 3B), and the path on which train A will travel is specified by assigning routes 4BR and 7R thereto. The initial position (initial route element) of train B is S20 (see FIGS. 3A and 3B), and the path on which train B will travel is specified by assigning routes 6L and 4L thereto. In this way, the table shown in FIG. 5B is prepared. The information acquiring unit 10 according to this embodiment receives the correspondence table shown in FIG. 5B as the travel path information. The travel path information which is described above is an example, and this embodiment is not limited to this example.

FIG. 6 is a diagram showing route setting information according to an embodiment of the present invention.

The "route setting information" used in this embodiment will be described below. The "route setting information" is information in which conditions to be satisfied when a route request for reserving a path on which a train will travel is given are defined for each route. More specifically, the "route setting information" is constituted by a table in which conditions under which a route request can be given when the traffic control system gives the route request to the interlock system in the automatic route setting function of the traffic control system are arranged and combined. For example, the dead lock described with reference to FIG. 2 occurs because the route request of train B is given up to the front of traffic light a in a step in which train A is present in block T2. Accordingly, the traffic control system needs to cause the route request of train B to stay in front of traffic light b (block T5) under the condition that train A is present in block T2. Then, while train B is stopped due to the "red" lighting of traffic light b, train A can arrive at block T8 as a destination by giving its route request (the route request is received and reserved for a route by the interlock system). When train B (which has stopped in block T5) gives a route request for a section up to block T2 again after train A departs from block T2, train B can arrive at the destination. The route setting table is a table in which conditions of whether the traffic control system may give a route request to the interlock system are arranged in order to prevent a deadlock.

The route setting information according to this embodiment is constituted by a condition correspondence table shown in FIG. 6.

First, in the table shown in FIG. 6, a route request condition is defined. This means that, for example, when the traffic control system transmits a route request for route 3R to the interlock system, the route request is transmitted only when a condition that "a train is present in block T1 and no train is present in block T3" is satisfied as the route request condition. Here, when the traffic control system transmits a request for route 3R on the condition that "a train is present in block T1," it is assumed that a train which will travel in route 3R enters block T1 and thus transmits a request for a next route (3R). The condition that "no train is present in block T3" is set to prevent two or more trains from being present in one block. The condition is also set to avoid a deadlock which may occur when a train is present in block T3.

In the table shown in FIG. 6, a request cancellation condition is defined. The traffic control system continuously transmits a route request until a target train enters a predetermined route. Accordingly, the traffic control system needs to cancel the route request at an appropriate timing after the train enters the route. The "cancellation of a route request" means that transmission of the route request is cancelled after a target train enters the route.

For example, when the traffic control system instructs the interlock system to cancel the route request for route 3R, it means that the route request is cancelled only when a condition that "a train is present in block T1 and a train is also present in block T3" is satisfied as the request cancellation condition. Here, when the traffic control system cancels a route request for route 3R on the condition that "trains are present in block T1 and block T3," it is assumed that a train which will travel in route 3R enters block T3 from block T1 and thus the route request for the route is cancelled.

In the table shown in FIG. 6, the underlined blocks are blocks in which a train is present, and the non-underlined blocks are blocks in which no train is present.

Like the route request condition for route 4L (FIG. 6), the route request condition may include whether the interlock system does not establish a route reservation for the routes (4AR and 4BR) competing with the section. The underlining of a route indicates that the route is in a state in which the interlock system has not established a route reservation for the route yet. The route setting table is a table which is normally manually prepared by a person, and needs to be prepared such that the above-identified deadlock does not occur in the traffic process.

FIG. 7 is a diagram showing the interlock system operation information according to an embodiment of the present invention.

The "interlock system operation information" is information in which a safe operation logic of the interlock system is defined. The safe operation logic of the interlock system determines whether a route reservation should be established in response to the route request from the traffic control system based on various conditions. When a route request for requesting a reservation of a route is transmitted from the traffic control system, the interlock system determines whether a route competing therewith has already been reserved. When a route has been completely reserved, the interlock system does not reserve the route in response to the request until the request condition is satisfied. For example, when a request for route 3R is transmitted, the interlock system starts control of route 3R on the condition that other routes 3AL, 3BL, 5L, and 4BR which compete with route 3R are not being controlled. These conditions are expressed and arranged using logical expressions, whereby the interlock system operation information shown in FIG. 7 is obtained. In FIG. 7, "!3AL" means that the control of route 3AL is not performed. "3RX" means that a route request for route 3R is transmitted.

The safe operation logic of the interlock system includes various definitions in addition to the above-identified definitions for the route reservation. For example, the interlock system detects whether a train is present in a predetermined block using the above-identified track circuit, and defines the safe operation logic in which two or more trains do not enter one block. Since the safe design logic of the interlock system is a limitation for defining whether a route should be reserved in response to a route request received from the traffic control system so as to secure safe traveling, whether the deadlock occurs as a result of the safety control is not considered and is not set. The avoidance of the deadlock is achieved by causing the traffic control system to transmit the route request after the condition determined by the route setting information is satisfied as described above.

A "requirement" input from the state transition model inspecting unit 13 is information serving as a condition for causing the state transition model inspecting unit 13 to determine whether the inspection of a given state transition model is appropriate. Specifically, the requirement regards whether a train travels without causing the deadlock in any state transition pattern in the state transition models generated by the state transition model inspecting unit 13 based on a variety of information acquired by the information acquiring unit 10.

Various state transition models generated by the state transition model generating unit 11 of the train traffic control inspection device 1 will be specifically described below with reference to the drawings.

Figure 8:
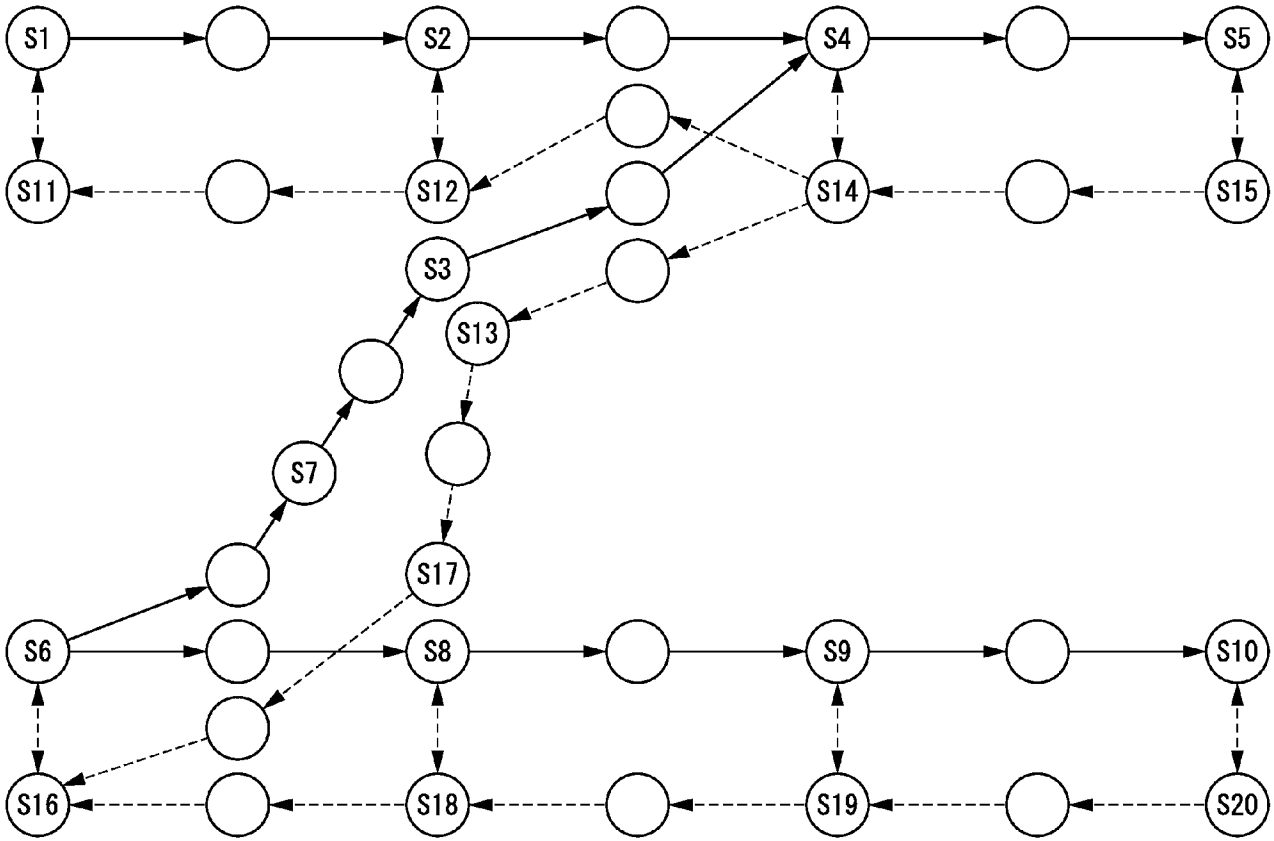
FIG. 8 is a diagram showing a state transition model of a train according to an embodiment of the present invention.

FIG. 8 is a diagram showing state transition models of trains according to an embodiment of the present invention. The state transition model generating unit 11 constructs a state transition model of a train based on the railroad topology information (FIGS. 4A and 4B) acquired by the information acquiring unit 10. Here, the state transition model generating unit 11 generates a state transition model including at least a state in which the train is in each route element and a state in which the train crosses a boundary of each route element as the states assumed for the train. Specifically, the state transition model generating unit 11 constructs a transition diagram of states of a train, that is, route elements in which the train is located as shown in FIG. 8, with reference to statuses of the route elements (to which block each route element belongs and connection relationships between the route elements) defined in the railroad topology information. The state of each train defined herein is reflected in a state transition condition of a traffic process to be described later. The numbers described in the states shown in the state transition diagram of FIG. 8 denote route elements. The white circles denote states in which a train is crossing the boundary between two route elements and thus is in both route elements. In this way, by constructing a state transition model by abstracting the process in which an actual train continuously travels, it is possible to perform inspection to include all the states of a train which are assumed in actual operations. Accordingly, the train traffic control inspection device 1 can further reduce omissions of the inspection of the train traffic control system.

The actual train traffic control system has to satisfy requirements given in operation of a train regardless of a train speed. Accordingly, the state transition model inspecting unit 13 of the train traffic control inspection device 1 verifies the state transition model of a train shown in FIG. 8 with the state transition patterns at all timings. At a position at which a traffic light is installed, it is assumed that a limitation that a train can enter the position only when the traffic light displays "green" lighting is provided (when a previous route reservation is established).

Figure 9:
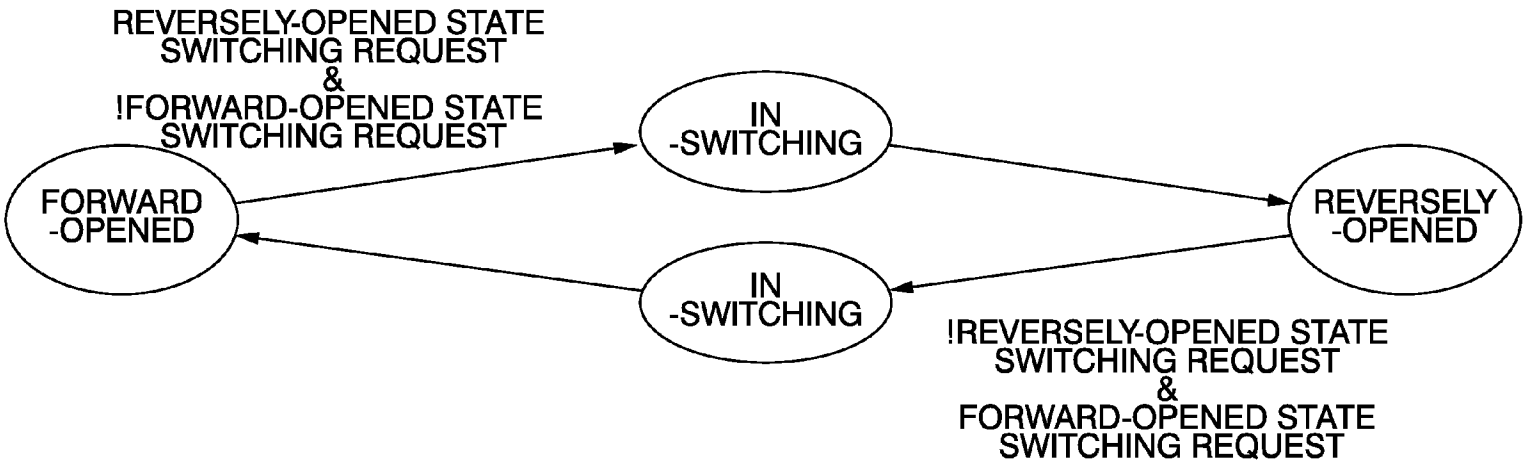
FIG. 9 is a diagram showing a state transition model in a branch according to an embodiment of the present invention.

FIG. 9 is a diagram showing a state transition model of a branch according to an embodiment of the present invention. The state transition model generating unit 11 constructs a state transition model of a branch for each branch installed in a given railroad network. In an actual branch, a route is switched under the mechanical control of a switch stand in response to an instruction from the interlock system. Accordingly, the state transition model generating unit 11 generates a state transition model including at least a forward-opened state, an in-switching state, and a reversely opened state as the states assumed in a branch. Specifically, the state transition model generating unit 11 constructs the state transition model of a branch shown in FIG. 9 and considers the state transition independently of the interlock system. Here, the state transition model shown in FIG. 9 represents that the state transitions through "forward-opened state"→"in-switching state"→"reversely opened state" on the condition that the branch is in a state in which a "reversely opened state switching request" is received from the interlock system and a "forward-opened state switching request" is not received when the branch is in the "forward-opened state." Similarly, the state transition model represents that the state transitions through "reversely opened state"→"in-switching state"→"forward-opened state" on the condition that the branch is in a state in which a "forward-opened state switching request" is received from the interlock system and a "reversely opened state switching request" is not received when the branch is in the "reversely opened state." A direction in which a branch is opened forward is referred to as a "forward-opened state" and the opposite direction is referred to as a "reversely opened state." The state transition model generating unit 11 constructs the state transition model of a branch for all branches which are present on the railroad network. The "forward-opened state switching request" and the "reversely opened state switching request" are input depending on the state transition models of the interlock system to be described below. In this way, by constructing the process in which an actual branch (switch stand) operates independently of the state transition of the interlock system, it is possible to perform the inspection in consideration of the time lag between the transmission of an instruction from the interlock system and the specific operation of the branch based thereon.

The actual train traffic control system has to satisfy conditions given in operation of a train regardless of a switching speed of a branch. Accordingly, the state transition model inspecting unit 13 verifies the state transition model of a branch shown in FIG. 9 with the state transition patterns at all timings.

FIGS. 10A, 10B, 10C, and 10D are first to fourth diagrams showing state transition models of the interlock system according to an embodiment of the present invention.

The state transition model generating unit 11 constructs a state transition model of the interlock system based on the interlock system operation information (security operation logic) (FIG. 7) acquired by the information acquiring unit 10. The state transition model generating unit 11 generates a state transition model including at least a state indicating whether each route is locked, a state indicating whether a train is present in each block, and a state in which set routes in each branch are detected as the states assumed in the interlock system. Specifically, the interlock system actually controlling traffic of a train is constituted by a set of electrical circuits (relays) for giving an instruction to traffic lights and switch stands. Accordingly, the state transition model generating unit 11 constructs a state transition model for each relay constituting the interlock system.

Figure 10A:
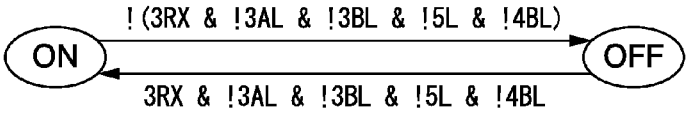
FIG. 10A is a first diagram showing a state transition model in an interlock system according to an embodiment of the present invention.

First, the state transition model generating unit 11 constructs a state transition model of a route lever relay that determines whether each route is locked (whether a reservation thereof is established). The route lever relay is a relay constituting the interlock system and is a relay that determines whether a route is locked. The state transition model of the route lever relay is constructed for each route on a railroad. As shown in FIG. 10A, the route lever relay can have any one of a state (ON) in which the route is reserved and a state (OFF) in which the route is not reserved. The condition of the state transition is defined based on the interlock system operation information (FIG. 7). For example, "relay 3R" for setting route 3R transitions from the OFF state to the ON state when none of route reservations 3AL, 3BL, 5L, and 4BL are established and a route request for route 3R is transmitted (3RX). On the other hand, when the above-identified condition is not satisfied, relay 3R is maintained in the OFF state. The reversely opened (forward-opened) state switching request" is output to a branch (switch stand) corresponding to relay 3R on the condition that relay 3R is in the ON state. The state transition model generating unit 11 constructs a state transition model of the interlock system in consideration of whether each route is locked in this way.

Figure 10B:
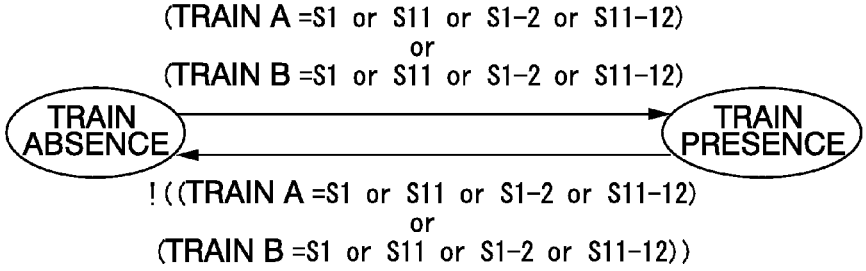
FIG. 10B is a second diagram showing a state transition model in an interlock system according to an embodiment of the present invention.

The state transition model generating unit 11 constructs a state transition model for a train-presence detection relay, separately from the route lever relay. The train-presence detection relay is a relay (a track circuit) that is installed in each block to detect whether a train is present in the corresponding block (whether a train is present). For example, the state transition model of the train-presence detection relay corresponding to block T1 is shown in FIG. 10B. The train-presence detection relay has one of a "train" state and a "no train" state depending on whether train A or train B is present in block T1. That is, when train A is present in any one of S1, S11, S1-2, and S11-12, block T1 is in the "train" state. Here, it is assumed that S1 and S11 represent states in which train A is present in each route element shown in FIG. 3B (FIG. 8) and S1-2 and S11-12 represents that train A crosses the boundary between route elements. The same is true of train B. The state transition model generating unit 11 constructs the state transition model of the interlock system in consideration of whether a train is present in each block in this way.

Figure 10C:
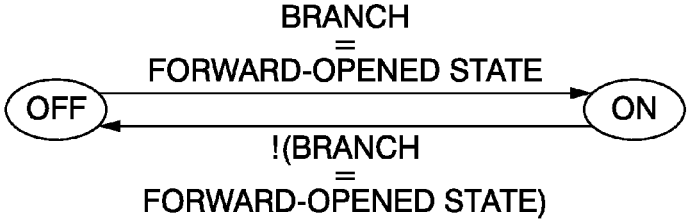
FIG. 10C is a third diagram showing a state transition model in an interlock system according to an embodiment of the present invention.
Figure 10D:
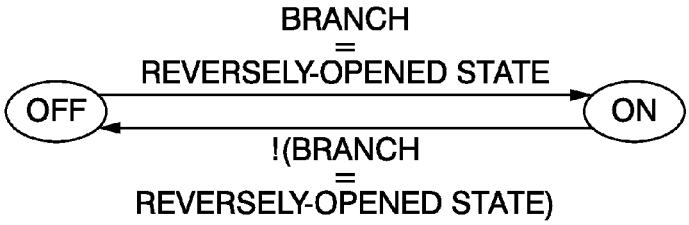
FIG. 10D is a fourth diagram showing a state transition model in an interlock system according to an embodiment of the present invention.

The state transition model generating unit 11 constructs a state transition model of a branch detection relay. The branch detection relay is a relay which is used for the interlock system to detect and recognize set routes in each branch. Here, a state of a branch and recognition of a state of a branch by the interlock system are separate matters. Accordingly, the state transition model generating unit 11 constructs the state transition model of the branch detection relay shown in FIGS. 10C and 10D as a state transition model of the interlock system. For example, when a branch is in the "forward-opened" state, the branch (forward-opened state) detection relay of the interlock system transitions to "ON" as shown in FIG. 10C and thus the interlock system recognizes that the branch is in the "forward-opened" state. The branch (reversely opened state) detection relay at this time is in an "OFF" state as shown in FIG. 10D. On the other hand, when the branch is in the "reversely opened" state, the branch (reversely opened state) detection relay transitions "ON" and the interlock system recognizes that the branch is in the "reversely opened" state. The branch (forward-opened state) detection relay at this time is in the "OFF" state. When the branch is in the "in-switching" state, every branch detection relay is in the "OFF" state.

As described above, by causing the state transition model generating unit 11 to abstract the actual interlock system as a set of various electrical circuits (relays), the train traffic control inspection device 1 can verify an operation pattern which has not been verified through the existing operation verification. For example, the state transition model inspecting unit 13 can perform the inspection to include the time lag until the interlock system actually recognizes the entrance after a train enters a block and a time lag until a switch stand starts its operation after the interlock system reserves a route.

Figure 11A:
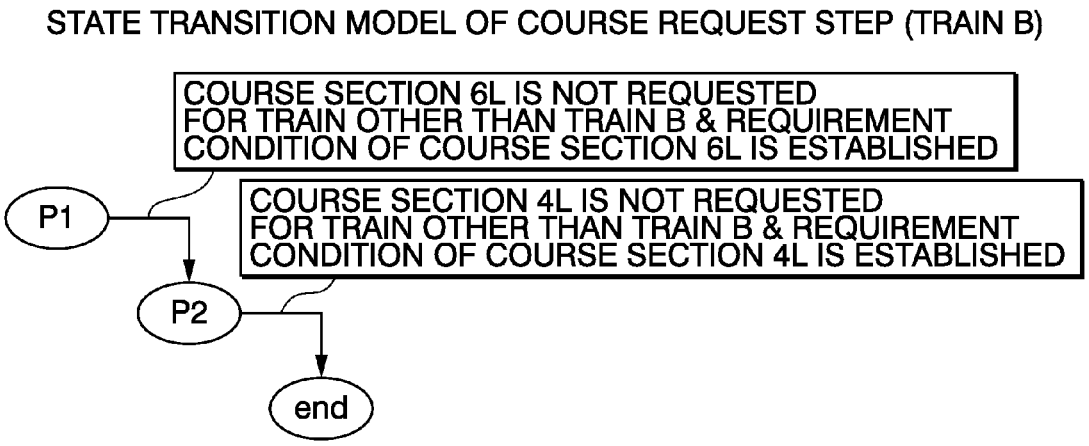
FIG. 11A is a first diagram showing a state transition model in a traffic control system according to an embodiment of the present invention.
Figure 11B:
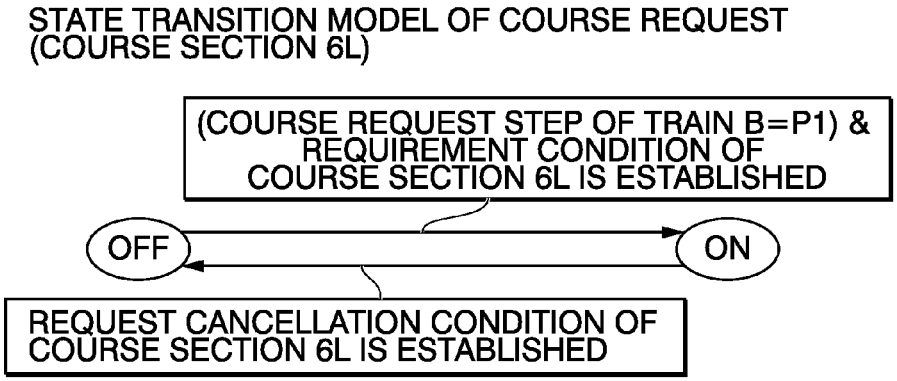
FIG. 11B is a second diagram showing a state transition model in a traffic control system according to an embodiment of the present invention.

FIGS. 11A and 11B are diagrams showing a state transition model of the traffic control system according to the embodiment of the present invention.

The state transition model generating unit 11 constructs a state transition model of the traffic control system based on the travel path information (FIGS. 5A and 5B) and the route setting information (FIG. 6) acquired by the information acquiring unit 10. The state transition model generating unit 11 generates a state transition model including at least a progress state of a route request step for each train and a state indicating whether a route request for each route is given as the states assumed in the traffic control system. In this embodiment, the state transition model generating unit 11 constructs a state transition model for the "automatic route setting" function which is a partial function of the traffic control system. Here, the actual traffic control system transmits a route request for a predetermined route to the interlock system such that each train travels in a path determined depending on the travel path information when the condition defined in the route setting information to avoid the deadlock is satisfied. Here, the state transition model generating unit 11 has a "route request step" corresponding to the travel path information for each train as a state transition model of the traffic control system. When the route setting information is established, the route request step progresses and the state transitions.

For example, the state transition model generating unit 11 constructs a state transition model of the traffic control system with the route request step shown in FIG. 11A. Here, the state transition diagram shown in FIG. 11A represents the route request step for train B in the travel path information shown in FIGS. 5A and 5B. That is, since train B is in S20 as an initial state, the traffic control system causes the route request step to progress so as to cause train B to transition from state S20 to state S16. Specifically, the traffic control system does not request route 6L for a train other than train 13 in the initial state P1 and the request step progresses to transition to a next state P2 when the request condition for route 6L (FIG. 6) is established. The traffic control system does not request route 4L for a train other than train B in the state P2, and the request step progresses to transition to a next state "end" (the route request step for train B ends) when the request condition for route 4L is established.

The state transition model generating unit 11 constructs a state transition model in which the traffic control system actually transmits a route request to the interlock system, regardless of the state of the route request step. Here, the state transition diagram shown in FIG. 11B represents a state in which the route request for route 6L is given. That is, the traffic control system is "OFF" (the state in which the route request for route 6L is not transmitted to the interlock system) in the initial state, and transitions to "ON" (the state in which the route request for route 6L is transmitted to the interlock system) when the route request step of train B is in the state P1 and the request condition for route 6L (FIG. 6) is established. In the state transition model of the interlock system, the route lever relay (FIG. 10A) can transition to "ON" in response to the switching of the route request for route 6L to "ON." Here, in order to actually reserve the route in the interlock system, it is necessary to satisfy the condition of the safe operation logic of the interlock system.

When a predetermined request cancellation condition (FIG. 6) is satisfied, the route request of the traffic control system itself transitions to "OFF." In FIG. 11B, when the request cancellation condition for route 6L is satisfied, the traffic control system considers the purpose to have been achieved and cancels the route request for route 6L. In the state transition model of the interlock system, the route lever relay for the route transitions to "OFF" in response to the switching of the route request for route 6L to "OFF" (FIG. 10A).

As described above, by causing the state transition model generating unit 11 to abstract the actual traffic control system independently of the interlock system, the traffic control system and the interlock system asynchronously perform processes and it is thus possible to verify the operation patterns which have not been verifiable hitherto. For example, the state transition model inspecting unit 13 can verify a problem with what happens when a new route request is transmitted in the time lag until the interlock system actually recognizes a route request after the traffic control system transmits the route request to the interlock system. That is, by constructing the entire state transition models such that only one of the train, the interlock system, and the traffic control system causes the transition at certain timing, it is possible to perform the inspection to include the time lag and the like.

Figure 12:
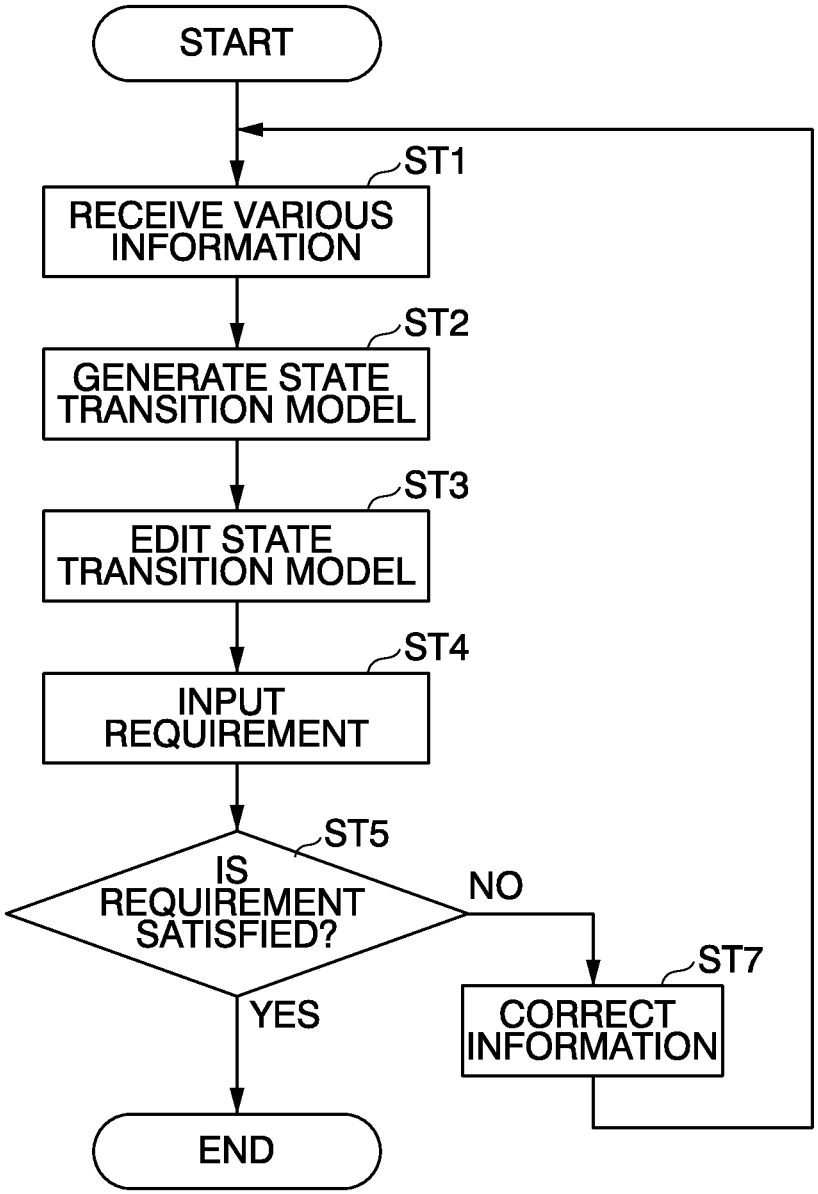
FIG. 12 is a diagram showing a verification flow using the train traffic control inspection device according to an embodiment of the present invention.

FIG. 12 is a diagram showing a verification flow using the train traffic control inspection device according to an embodiment of the present invention.

A specific verification flow using the train traffic control inspection device 1 according to this embodiment will be described below with reference to FIG. 12. First, the information acquiring unit 10 acquires a variety of information (step ST1). Here, the acquired information includes the "railroad topology information," the "travel path information," the "route setting information," and the "interlock system operation information." Then, the state transition model generating unit 11 constructs various state transition models based on the information acquired by the information acquiring unit 10 (step ST2). The state transition models constructed herein include, for example, the state transition model of a "train," the state transition model of a "branch," the state transition model of the "interlock system," and the state transition model of the "traffic control system." For example, the state transition model of the "interlock system" is constituted by a set of the state transition models of various relays (the "route lever relay" for each route, the "train-presence detection relay" for each block, and the "branch detection relay" for each branch (FIGS. 10A to 10D). The state transition model of the "traffic control system" is constituted particularly by the "route request step" for each train and the "route request" for each route (FIGS. 11A and 11B). Then, if necessary, a user edits the state transition models generated as described above into a desired state transition model using the state transition model editing unit 16 (step ST3). Then, the state transition model inspecting unit 13 receives "requirements" set by the user (step ST4). Here, for example, the requirements are "requirements for performing the traffic schedule without delay (without causing the deadlock) in accordance with a prearranged traffic schedule regardless of a state transition sequence followed by train traffic control system," and are given in a format which can be analyzed by a computer, such as computed tree logic (CTL). Specifically, the state transition model inspecting unit 13 receives the conditions determined for each train such as whether train A arrives at the destination of block T8 and whether train B arrives at the destination of block T2 as the requirements.

The state transition model inspecting unit 13 verifies the state transition patterns which can be assumed in the real world based on the given state transition models and the "requirements" thereof using a predetermined model inspection method, and determines whether the given "requirements" are satisfied in all the state transition patterns which can be taken by the train traffic control system (step ST5). Since the number of combinations of states in the state transition models is vast, inspection using simulation is not possible, but it is possible to logically determine whether the state transition model is appropriate using a model inspection method.

In this embodiment, the state transition model generating unit 11 independently defines the states which can be taken by the interlock system (various relays) and the states which can be taken by the traffic control system as described above. Then, the state transition model inspecting unit 13 can inspect problems with what happens when a new route request for another train is transmitted from the traffic control system in the time lag until the interlock system actually recognizes a route request after the traffic control system transmits the route request to the interlock system.

Through this comprehensive inspection, it is possible to verify all combinations which can occur in the asynchronous state transitions of the interlock system and the traffic control system without being limited to the test patterns of the interlock system and the traffic control system.

When the requirements are satisfied, the train traffic control inspection device 1 determines that the given information does not have an error and ends the processes. On the other hand, when a state transition not satisfying the requirements is present, the initially-prepared information (particularly the route setting information) is considered to include a defective that may cause the deadlock. Accordingly, the user finds the defect using the counterexample analyzing unit 14 and corrects the information (step ST7). The corrected information is input to the information acquiring unit 10 again and the inspection processes are repeated subsequently.

Hereinafter, an example of verification which is performed by the train traffic control inspection device 1 will be specifically described.

Figure 13:
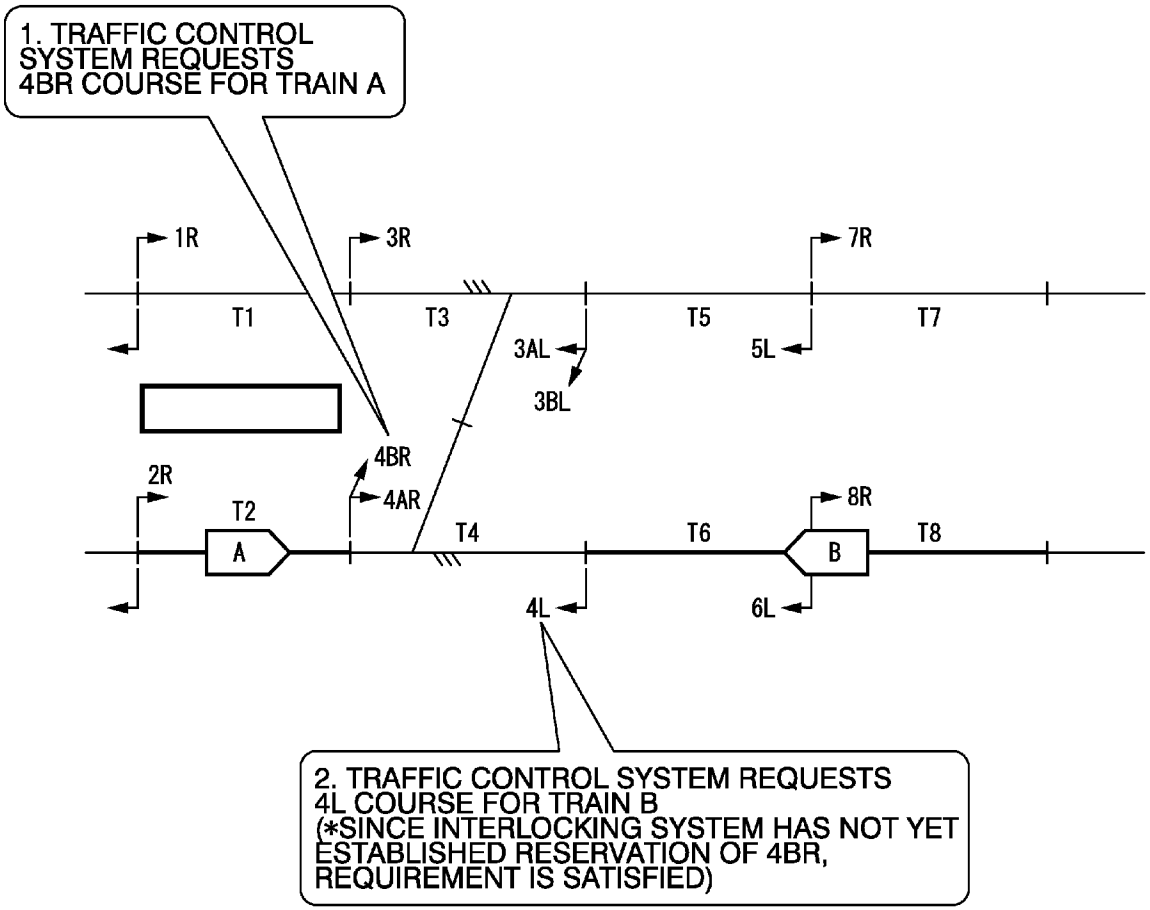
FIG. 13 is a first diagram showing a verification process of the train traffic control inspection device according to an embodiment of the present invention.

FIG. 13 is a first diagram showing a verification process of the train traffic control inspection device according to the embodiment of the present invention.

The requirements added in FIG. 13 are a requirement that train A travels to block T7 via routes 4BR and 7R and a requirement that train B travels to block T2 via route 4L. FIG. 13 shows a state in which the route request condition for route 4BR for train A is satisfied and the route request is transmitted from the traffic control system to the interlock system, but the interlock system does not recognize the route request yet (this state is maintained for about 0.3 seconds in reality). Blocks indicated by bold lines are blocks which are detected to be in the "train" state by the interlock system. Since train B enters block T6 in this state, the traffic control system transmits a route request for route 4L to the interlock system. The conditions that a train is present in block T6 and no train is present in block T4 in the state in which the interlock system has not established the route reservation for 4AR and 4BR are satisfied (FIG. 6). Here, the route request for 4BR has already been transmitted. On the other hand, since the interlock system separately recognizes that a train is present in block T2 using the train-presence detection relay, the interlock system does not reserve route 4L in response to the route request for route 4L and defers the determination.

Figure 14:
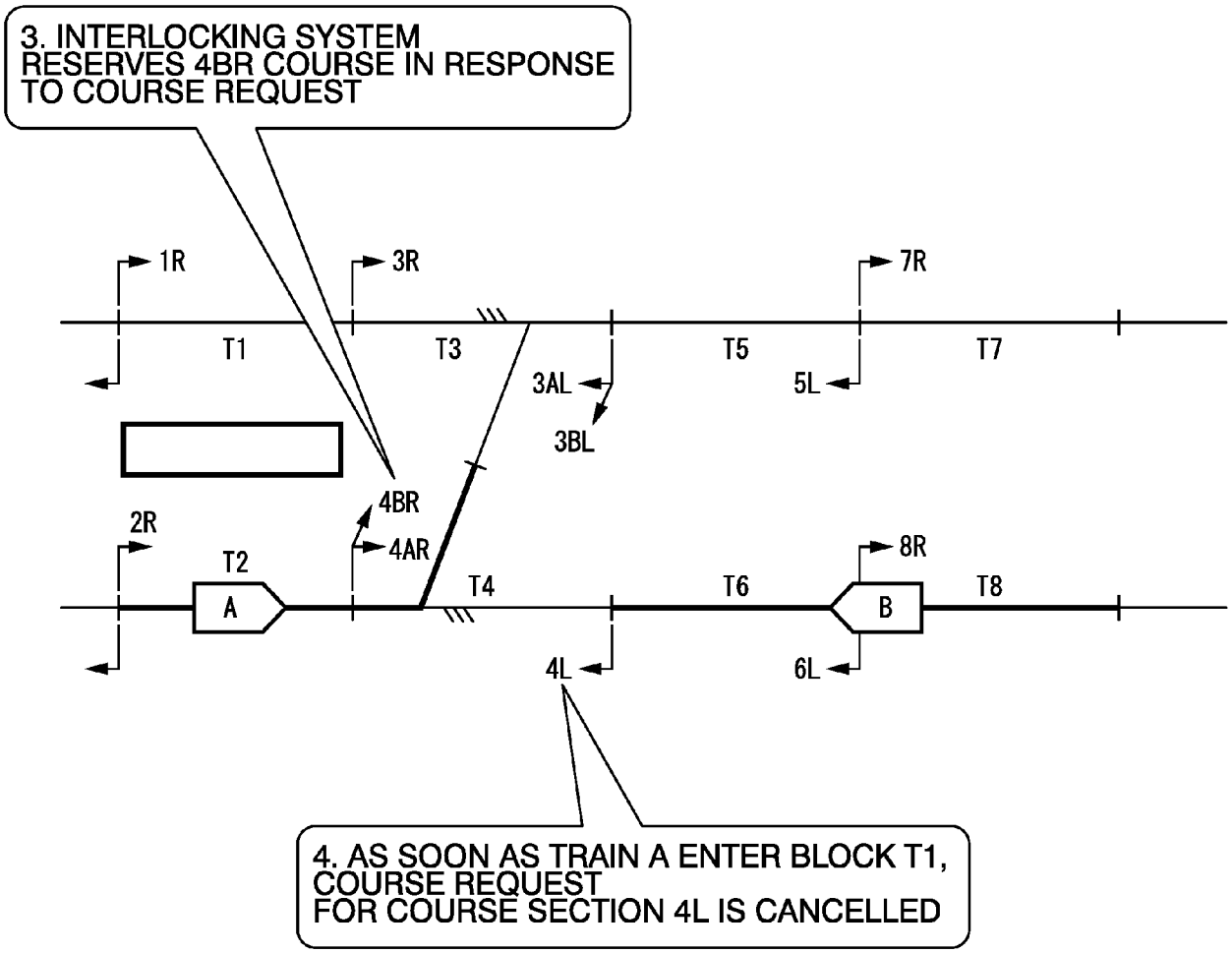
FIG. 14 is a second diagram showing a verification process of the train traffic control inspection device according to an embodiment of the present invention.

FIG. 14 is a second diagram showing a verification process of the train traffic control inspection device according to the embodiment of the present invention.

Subsequently to the state shown in FIG. 13, the interlock system establishes the route reservation for route 4BR in response to the route request for the route 4BR from the traffic control system. Then, train A travels in accordance with the "green" lighting of the traffic light corresponding to route 4BR and enters block T4 (FIG. 14). At this time, the traffic control system cancels the route request for route 4L transmitted for train B, because the route request cancellation condition for route 4L is satisfied (a train is present in block T6 and a train is present in block T4) (FIG. 6).

Figure 15:
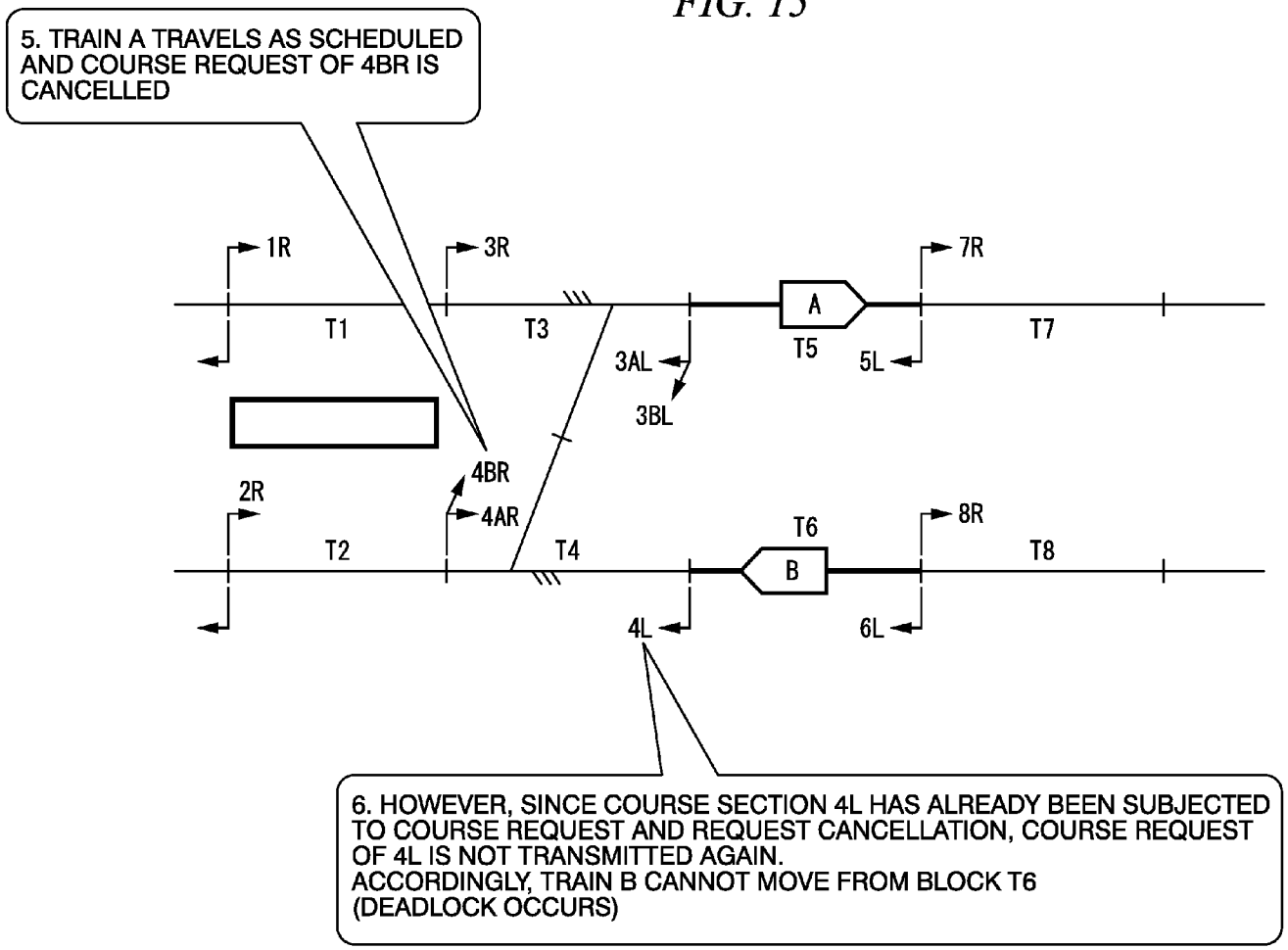
FIG. 15 is a third diagram showing a verification process of the train traffic control inspection device according to an embodiment of the present invention.

FIG. 15 is a third diagram showing a verification process of the train traffic control inspection device according to the embodiment of the present invention.

Train A travels in route 4BR as scheduled in the state shown in FIG. 14 and arrives at block T5. Then, since the route reservation request for route 4BR for train A satisfies the request cancellation condition, the traffic control system cancels the route request for route 4BR and cancels the route reservation. However, although the reservation for route 4BR is cancelled and the route reservation for route 4L is maintained, the traffic control system is in a state in which the route request is cancelled again via the state in which the route request for route 4L has been transmitted. Accordingly, the traffic control system does not transmit the route request for route 4L again (for train B). As a result, since the subsequent route is not secured after train B travels to block T6, train B is maintained in the stopped state (deadlock occurs).

Basically, the route setting information is prepared on the assumption that train B crosses between block T6 and block T4 and thus the request cancellation condition is satisfied. However, the deadlock described with reference to FIGS. 13 to 15 occurs because the request cancellation condition is satisfied in an unexpected form in which train A enters block T4 and train B enters block T6. This causes an event in which train B enters block T6 from block T8 in unlikely state (in a short period of time) in which the route request is not recognized by the interlock system just after the traffic control system transmits the route request for route 4BR for train A. In the inspection method in the related art, this unlikely case could not be verified.

As described above, according to the train traffic control inspection device 1, it is possible to verify cases which have not been verifiable by independently constructing the state transition model of the interlock system and the state transition model of the traffic control system and giving the causal relationships to only the state transition conditions. For example, it is possible to verify even the above-identified case (a new event occurs in a time zone in which the traffic control system transmits a route request but the interlock system does not recognize the route request).

According to this embodiment, it is possible to perform the inspection to include situations with a low probability of occurring in operation of the train traffic control system.

FIGS. 16A, 16B, and 16C are diagrams showing a state transition model in a predetermined model inspection language according to an embodiment of the present invention.

The train traffic control inspection device 1 according to this embodiment may have a configuration in which the above-identified state transition models are described in a predetermined model inspection language. In this case, for example, a state transition model of the interlock system is described with source codes shown in FIGS. 16A to 16C.

The train traffic control inspection device 1 has a computer system therein. The processes of the train traffic control inspection device 1 are stored in a computer-readable recording medium in the form of a program and the processes are performed by causing the computer to read and execute the program. Here, examples of the computer-readable recording medium include a magnetic disk, a magneto-optical disc, a CD-ROM, a DVD-ROM, and a semiconductor memory. The computer program may be transmitted to a computer via a communication line and the computer having received the computer program may execute the program.

INDUSTRIAL APPLICABILITY

According to the train traffic control inspection device, the train traffic control inspection method, and the program, it is possible to inspect the train traffic control system to include situations with a low probability of occurring in operation of the train traffic control system.

REFERENCE SIGNS LIST

1 Train traffic control inspection device
10 Information acquiring unit
11 State transition model generating unit
12 State transition model storage unit
13 State transition model inspecting unit
14 Counterexample analyzing unit
15 Result displaying unit
16 State transition model editing unit

The invention claimed is:

1. A train traffic control inspection device that verifies an operation of a train traffic control system including an interlock system and a traffic control system, the train traffic control inspection device comprising:

an information acquiring unit configured to acquire railroad topology information indicating a configuration of a railroad network in which a plurality of blocks are connected and which includes one or more branches, travel path information specifying a path of a train which travels on the railroad network by combination of one or more routes for each train, route setting information in which conditions to be satisfied when a route request for reserving a path on which a train will travel is given are defined for each route, and interlock system operation information in which safe operation logics of the interlock system are defined;

a state transition model generating unit configured to generate a state transition model for each of the train, the branch, the interlock system, and the traffic control system based on the information acquired by the information acquiring unit; and a state transition model inspecting unit configured to determine whether a predetermined requirement is satisfied by each combination of states which is able to occur while transiting the present state in either the train, the branch, the interlocking system or the traffic control system to other states depending on the state transition caused in either the train, the branch, the interlocking system or the traffic control system based on the state transition models.

2. The train traffic control inspection device according to claim 1, wherein the state transition model generating unit generates a state transition model including at least a state in which the train is in each route element obtained by dividing the route in units of the blocks and a state in which the train crosses a boundary of each route element as the states assumed in the train.

3. The train traffic control inspection device according to claim 1, wherein the state transition model generating unit generates a state transition model including at least a forward-opened state, an in-switching state, and a reversely-opened state as the states assumed in the branch.

4. The train traffic control inspection device according to claim 1, wherein the state transition model generating unit generates a state transition model including at least a state indicating whether each route is locked and a state indicating whether a train is present in each block as the states assumed in the interlock system.

5. The train traffic control inspection device according to claim 1, wherein the state transition model generating unit generates a state transition model including at least a progress state of a route request step for each train and a state indicating whether a route request for each route is present as the states assumed in the traffic control system.

6. A train traffic control inspection method of verifying an operation of a train traffic control system including an interlock system and a traffic control system, the train traffic control inspection method comprising:

acquiring railroad topology information indicating a configuration of a railroad network in which a plurality of blocks are connected and which includes one or more branches, travel path information specifying a path of a train which travels in the railroad network on a combination of one or more routes for each train, route setting information in which conditions to be satisfied when a route request for reserving a path on which a train will travel is given are defined for each route, and interlock system operation information in which safe operation logics of the interlock system are defined;

generating a state transition model for each of the train, the branch, the interlock system, and the traffic control system based on the acquired information; and determining whether a predetermined requirement is satisfied by each combination of states which is able to occur while transiting the present state in either the train, the branch, the interlocking system or the traffic control system to other states depending on the state transition caused in either the train, the branch, the interlocking system or the traffic control system based on the state transition models.

7. A program causing a computer of a train traffic control inspection device, which verifies an operation of a train traffic control system including an interlock system and a traffic control system, to serve as:

information acquiring means configured to acquire railroad topology information indicating a configuration of a railroad network in which a plurality of blocks are connected and which includes one or more branches, travel path information specifying a path of a train which travels in the railroad network on a combination of one or more routes for each train, route setting information in which conditions to be satisfied when a route request for reserving a path on which a train will travel is given are defined for each route, and interlock system operation information in which safe operation logics of the interlock system are defined;

state transition model generating means configured to generate a state transition model for each of the train, the branch, the interlock system, and the traffic control system based on the information acquired by the information acquiring unit; and state transition model inspecting means configured to determine whether a predetermined requirement is satisfied by each combination of states which is able to occur while transiting the present state in either the train, the branch, the interlocking system or the traffic control system to other states depending on the state transition caused in either the train, the branch, the interlocking system or the traffic control system based on the state transition models.

* * * * *